US005710725A

United States Patent [19]

Bott et al.

[11] Patent Number: 5,710,725

[45] Date of Patent: Jan. 20, 1998

[54] PROCESS FOR THE POSITION DETECTION OF A LINEARLY DRIVEN DRIVE SYSTEM

[75] Inventors: Klaus Bott, Durmersheim; Eckhard Schwendemann, Bühl, both of Germany

[73] Assignee: Landis & Gyr Technology Innovation AG, Switzerland

[21] Appl. No.: 571,149

[22] Filed: Dec. 12, 1995

[30] Foreign Application Priority Data

Dec. 20, 1994 [CH] Switzerland ..... 3830/94

[51] Int. Cl.[6] ..... G01P 3/36

[52] U.S. Cl. ..... 364/559; 364/565; 364/167.01; 364/571.01; 318/696

[58] Field of Search ..... 901/24; 33/1 PT; 200/231.13–231.18; 318/560, 561, 696, 489; 73/116, 54.33; 364/167.01, 474.01, 565, 559, 571.01; 340/671

[56] References Cited

U.S. PATENT DOCUMENTS

| | | | |
|---|---|---|---|
| 4,272,710 | 6/1981 | Duill et al. | 318/470 |
| 4,417,188 | 11/1983 | Makabe et al. | 364/400 |
| 4,445,087 | 4/1984 | Mehnert | 324/175 |
| 4,673,160 | 6/1987 | Tolley . | |
| 4,880,376 | 11/1989 | Bartels et al. . | |

FOREIGN PATENT DOCUMENTS

| | | |
|---|---|---|
| 2433709 | 3/1980 | France . |
| 59-137680 | 8/1984 | Japan . |
| 3204561 | 9/1991 | Japan . |
| 4024412 | 1/1992 | Japan . |
| 4024413 | 1/1992 | Japan . |

*Primary Examiner*—Emanuel T. Voeltz
*Assistant Examiner*—Craig Steven Miller
*Attorney, Agent, or Firm*—Greer, Burns & Crain, Ltd.

[57] ABSTRACT

An angular position change of the linearly driven drive system is proportional to its particular running time. In the process there is determined a desired value of the running time of the drive system belonging to a desired-value angular position ($\alpha_s$), the drive system is thereupon started and its running time is measured and, when a measured value of the running time is equal to the determined desired value of said running time, the drive system is stopped. By this process the dependability of the drive system is improved and the costs of the latter are reduced.

6 Claims, 2 Drawing Sheets

PROCESS FOR THE POSITION DETECTION OF A LINEARLY DRIVEN DRIVE SYSTEM

The present invention generally relates to a process for detecting the position of an output of a linearly driven drive system, and more particularly to such a system which is operable without use of expensive position sensors.

The process of the invention is used preferably in damper actuator drives for burners in heating installations. It is also advantageously useful in angularly positionable drives for dampers and the like, and is useful in frequency converters.

There are known methods for detecting the angular position of the output of drive systems which utilize either analog or digital sensors coupled to the movement axes of the drive systems for accurately determining the output position. However, such sensors are often relatively expensive, and the system is often required to have special drives and, by reason of the additionally present sensors, is relatively subject to breakdown.

Accordingly, it is a primary object of the present invention to improve the known processes so that the dependability of the drive systems is improved and the costs of the latter are reduced.

Another object of the present invention is to provide such an improved process which utilizes only a few simple limit switches in combination with a processing means and adaptive techniques to calibrate the drive systems and achieve desired operating accuracy without the use of expensive sensing equipment.

Other objects and advantages will become apparent from reading the following detailed description, while referring to the attached drawings.

DETAILED DESCRIPTION

Figure 1:
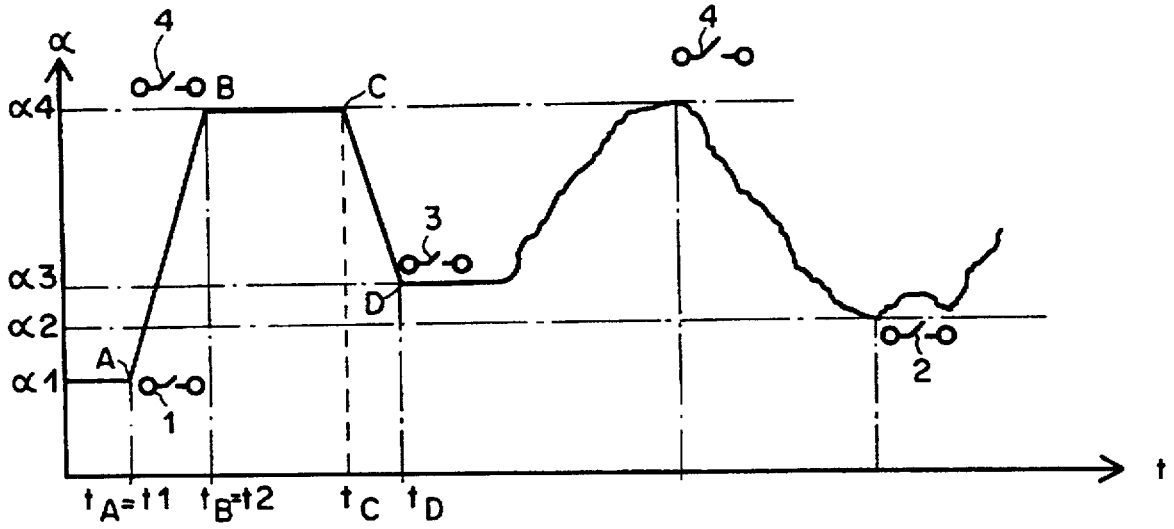
FIG. 1 shows a time diagram of a measuring course in a damper actuator in a burner present in a heating installation.

A damper actuator drive has, for reasons of safety technology and/or for reasons of calibration, several limit-value or limit switches in burner applications. For example, a damper actuator drive in a burner application which is preferably an air-damper actuator drive, has at least four limit switches 1, 2, 3 and 4 functioning as mechanical-end switches (See FIG. 1), the positions of which are settable. In the case of the frequency converter, the settable limit switches are preferably air pressure switches, although other types of switches can bee used. A first limit switch 1 is arranged, for example in an angular position $\alpha 1$, a second limit switch 2 in an angular position $\alpha 2$, a third limit switch 3 in an angular position $\alpha 3$ and a fourth limit switch 4 in an angular position $\alpha 4$ (see FIG. 1 and FIG. 2).

The angular position $\alpha 1$ is, for example, a closed position of the damper actuator drive, i.e., the angular position at which the air damper is closed, which corresponds to an opening of the air damper of 0%. The angular position $\alpha 2$ is, for example, a low-load position of the burner and corresponds to an opening of the air damper of x%. The angular position $\alpha 3$ is, for example, the ignition-load position of the burner and corresponds to an opening of the air damper at y%. The angular position $\alpha 4$ is, for example, an open position of the damper actuator drive, in which the air damper is completely open, which corresponds to a 100% opening of the air damper.

The limit switches 1 to 4 are used in the process of the invention, except for reasons of safety technology, only in addition for the purpose of calibrations and/or recalibrations. During a normal operation of the drive system, however, they are not used. Neither are there used any other sensors nor any additional limit—value switches, for example in angle intermediate positions. The additional limit switches or sensors are as a rule expensive and subject to malfunction, and through their non-use costs are saved and the operating dependability is improved.

An angular position $\alpha$ of a linearly driven drive system is proportional to a time t which the drive system requires in order, proceeding from a reference point, for example when $\alpha=0$, to reach the angular position $\alpha$. There holds, therefore:

$$\alpha = Wt \text{ and}$$

$$\Delta\alpha = W\Delta t \qquad (1),$$

in which W is a constant angular velocity of the drive system. The angular position change $\Delta\alpha$, therefore the change of an angular path to be covered, is proportional to a particular running time $\Delta t$ required for the angular position change. From the running time $\Delta t$ of the drive system it is possible to draw a conclusion on a certain path or angular position change $\Delta\alpha$ of the drive system, if the constant value of the angular velocity W is known. This value is either given as a parameter or it can be determined from the drive system, for example on the occasion of setting-in-operation, with the aid of two limit switches such as the two limit switches 1 and 4. In the latter case before a first setting-in-operation of the drive system, the value of the angular velocity W of the drive system is determined with the aid of the two limit switches 1 and 4 and thereupon stored for the purpose of later use in a particular determination of a desired value $\Delta t_S$ of the running time $\Delta t$ of the drive system belonging to a desired value angular position $\alpha S$ There holds here:

$$W = (\alpha 4 - \alpha 1)/(t4 - t1),$$

in which t4 and t1 are in each case the times that the drive system needs in order, proceeding from a reference angular position, for example $\alpha=0$, to reach the angular position $\alpha 4$ or $\alpha 1$. The time difference t4–t1, therefore, is a measured running time $\Delta t$ of the drive system in order, proceeding from the angular position $\alpha 1$, to reach the angular position $\alpha 4$.

Figure 2:
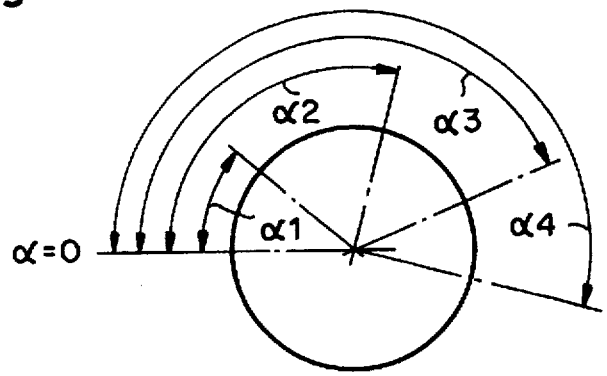
FIG. 2 is a schematic representation of the angular positions of four limit-value switches of a drive system.

Similarly, two further measurements, with, in each case a proper calculation, can yield the values of x% and y%, since $$x = W(t_2 - t_1) \text{ and}$$

$$y = W(t_3 - t_1),$$

in which $t_2$ and $t_3$ are in each case the times that the drive system needs, proceeding from the reference angular position; in order to reach the angular position $\alpha 2$ or $\alpha 3$. The time differences $t_2 - t_1$ and $t_3 - t_1$ are, therefore, measured running times $\Delta t$ of the drive system in order, proceeding from the angular position $\Delta 1$, to reach the angular position $\alpha 2$ or $\alpha 3$. In FIG. 1 there is represented a possible course of the angular positions $\alpha$ of the drive system as a function of the time. In the representation of FIG. 1 there is given at the left, by means of straight characteristic line parts, a possible time course of the drive system on the occasion of a setting-in-operation, while on the right there is represented a possible time course on the occasion of a normal operation of the drive system. In the latter case the angular position $\alpha$ of the drive system after the setting-in-operation fluctuates, for example, between the angular positions $\alpha 4$ and $\alpha 2$. In FIG. 1 there holds the assumption that $\alpha 2$ is less than $\alpha 3$, which, however, is not always the case. At the beginning of the setting-in-operation the drive system has; for example, the angular position $\alpha 1$ up to the time point $t_A=t_1$ (see point A of the time diagram), in order thereupon, at the constant speed W, to move up to the angular position $\alpha 4$, which it reaches the time point $t_B=t4$ (see point B of the time diagram). The moving up is represented in FIG. 1 by a straight line AB, the inclination of which is W. After reaching the angular position $\alpha 4$, for example, the drive system remains in this position up to the time point $t_C$ (see point C of the time diagram) in order thereupon to move down at a constant rate W to the angular position $\alpha 3$, which it reaches at time point $t_D$ (see point D of the time diagram) and from which it starts for the following normal operation. The downward movement is represented by a straight line CD, the inclination of which is −W.

The angular position changes $\Delta\alpha$ of the drive system are, as already mentioned, proportional to its running time $\Delta t$. According to the invention for the position detection of the linearly driven drive system, a desired value $\Delta t_S$ belonging to a desired angular position $\alpha_S$ of the running time $\Delta t$ of the drive system is determined, and the drive system is thereupon started and its running time $\Delta t$ is measured without sensor. When a measured value of the running time $\Delta t$ is equal to the determined desired value $\Delta t_S$ of the running time $\Delta t$, the drive system is stopped, the angular position $\alpha$ of which is then equal to the desired value of the angular position $\alpha_S$, since the desired value $\Delta t_S$ is the running time $\Delta t$ of the drive system which the latter requires in order, proceeding from an angular reference position, to reach the desired angular position $\alpha_S$.

Figure 3:
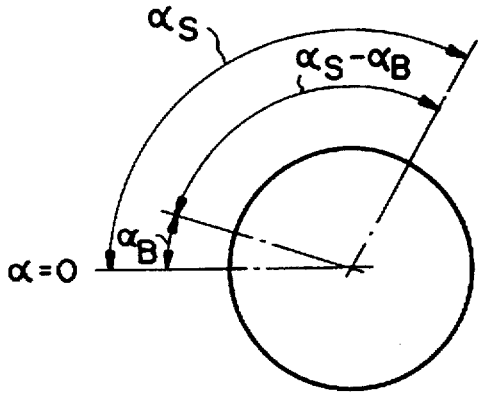
FIG. 3 is a schematic diagram of angular positions in the process according to the invention; and, FIG. 4 is a schematic representation of angular positions in a recalibration.

The angular reference position is, for example, the closed position $\alpha 1$ of the damper actuator drive. It can, however, also be any other arbitrary angular position $\alpha_B$ of the damper actuator drive in which this is momentarily present and from which it starts in order to reach the desired angular position $\alpha_S$ (see FIG. 3). The reference angular position is in this case the position of the damper actuator drive before the last drive command. An integration of equation (1) yields:

$$\alpha=W\Delta t+\alpha_B$$

with $\alpha=\alpha_S$ and $\Delta t=\Delta t_S$, so that:

$$\Delta t_S=(\alpha_S-\alpha_B)/W \tag{2}$$

The required running time $\Delta t_S$ in order, proceeding from the momentary angular position $\alpha_B$, to reach the desired angular position $\alpha_S$ can thus be computed by, for example, a microcomputer present in the drive system by means of a table stored in it, or by means of equation (2), whereupon the microcomputer, after a subsequent start of movement of the drive system, still has only to measure the running time $\Delta t$, in order to stop the drive system after the reaching of the running-time desired value $\Delta t_S$. The latter is then in the desired angular position $\alpha_S$ without any sensor being required to detect a reaching of the position $\alpha_S$ concerned. The respective values of $\alpha_S$ and $\Delta t_S$ are stored in the microcomputer and can serve as new starting values of the run-off movement with the next run-off command.

Figure 4:
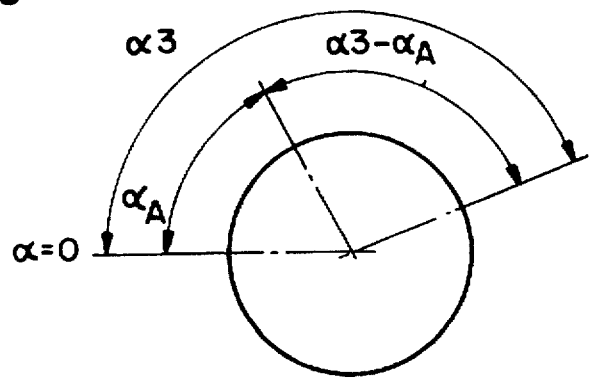

In parallel-conducted drive systems, i.e when several heating boilers are operated simultaneously and the corresponding burners are operated synchronously, there can occur an unwanted driving of the whole system through tolerances of the individual drive systems. In a variant of the process of the invention, therefore, by a cyclical starling of the drive system at one of the four limit-value switches, for example at the limit-value switch 3, there occurs a pinpointed recalibration, as, in each case on the one hand a desired-value/actual-value difference $D=\Delta t_{S,E}-\Delta t_E$ of a determined desired value $\Delta t_{S,E}$ and of a measured actual value $\Delta t_E$ of a running time $\Delta t$ is determined, which is required in order, proceeding from a momentary angular position $\alpha_A$ of the drive system, to reach the desired-value switch 3 (see FIG. 4). On the other hand, furthermore, a hitherto-holding angular velocity W of the drive system is multiplied with a correction factor k, which is a function f[D] of the desired-value/actual-value difference D, in order to obtain an angular velocity $W_E$ holding after the recalibration, which is then subsequently used in the process, until the next recalibration in each case for the determination of the desired value $\Delta t_S$ of the running time $\Delta t$.

The microcomputer measures, for example, the actual value $\Delta t_E$ of the running time $\Delta t$ that the drive system requires to reach the angular position $\alpha 3$ of the limit-value switch 3 from its momentary angular position $\alpha_A$. The microcomputer compares this measured actual value $\Delta t_E$ with the desired value $\Delta t_{S,E}$ determined, i.e. calculated, by it for the running time $\Delta t$, that is necessary to cover the same interval, as it determines, that is to say calculates, the desired-value/actual-value difference $D=\Delta t_{S,E}-\Delta t_E$. Theoretically the difference D must be zero, since the two values should be equal. If not, then not only is the difference D different from zero, but also the correction factor k is different from one.

Here there hold the equations:

$$W_E=kW$$
$$k=f[D] \tag{3}$$

in which $W_E$ and W are the angular velocities after and before the recalibration, while k is the correction factor dependent on D. By the cyclical starting, the calculated value for the angular velocity W is periodically corrected by means of equation (3) and the error of the determined position values in the course of time becomes less and less. There is thus achieved an adaptive behavior of the drive system and the value used for the angular velocity W. is optimized over the operating time.

The choice of the limit switch to be started cyclically for the recalibration is made preferably in dependence on the process. In a preferred execution there is selected as cyclically startable limit switch, the switch that can be started most rapidly by the drive system fore its momentary position $\alpha_A$, i.e., the one that can be reached most rapidly.

If the drive of the drive system is a step motor, the angular positions $\alpha$ of the drive system in the process of the invention are preferably expressed in step numbers n. A number of steps $\Delta n$ required for an angular position change $\Delta\alpha$, is yielded from the equation:

$$\Delta n=\Delta\alpha/SW,$$

in which SW represents a constant step width of the step motor. According to equation (1), $\Delta t$ is thus likewise proportional to $\Delta n$.

If the drive system is a part of the frequency converter, the angular positions correspond preferably to rotation rates N. A rotation rate change $\Delta N$ required for the angular position change $\Delta\alpha$ is yielded from the equation:

$$\Delta N = \Delta\alpha / 2\pi$$

According to equation (1), $\Delta t$ is likewise proportional to $\Delta N$.

While various embodiments of the present invention have been shown and described, it should be understood that various alternatives, substitutions and equivalents can be used, and the present invention should only be limited by the claims and equivalents of the claims.

Various features of the present invention are set forth in the following claims.

What is claimed is:

1. A process for detecting the angular position of a linearly driven drive system, of the type where the angular position change ($\Delta\alpha$) is proportional to its particular running time ($\Delta t$) and which has a processing means and associated memory, and at least two limit switches adapted to operate at respective known predetermined angular positions, the process comprising the steps of:

determining a desired value ($\Delta t_S$) for the running time ($\Delta t$) of the drive system corresponding to the desired angular position value ($\alpha_S$);

starting the drive system and measuring its running time ($\Delta t$); and, stopping the drive system when a measured value of the running time ($\Delta t$) is equal to a determined desired value ($\Delta t_S$) of the running time ($\Delta t$).

2. A process according to claim 1, further comprising:

determining a value of the angular velocity (W) of the drive system before initial start-up of the drive system with the aid of two of said limit switches and storing said determined desired value ($\Delta t_S$) of the running time ($\Delta t$) of the drive system corresponding to the desired angular position ($\alpha_S$) in said memory for later use by said processing means.

3. A process according to claim 2, further comprising:

recalibrating said drive system by cyclically starting the drive system from the angular position defined by at least one of several limit switches (3) and determining a desired-value/actual-value difference (D) for a predetermined desired value ($\Delta t_{S,E}$) and for a measured actual value ($\Delta t_E$) of a running time ($\Delta t$) which is required when proceeding from a known momentary angular position ($\alpha_A$) of the drive system, to reach one of said limit switches (3), and, multiplying the angular velocity (W) of the drive system by a correction factor (k) which is a function of the desired-value/actual-value difference (D) to obtain an angular velocity ($W_E$) which is subsequently used in the process until a subsequent recalibrating step is carried out for determining of the desired value ($\Delta t_S$) of the running time ($\Delta t$).

4. A process according to claim 3 further characterized in that the one of said limit switches to be cyclically started is the one that can be most rapidly started by the drive system.

5. A process according to claim 1, further characterized in that said drive system comprises a step motor and the angular positions ($\alpha$) of said drive system are expressed in numbers (n) of steps.

6. A process for detecting the angular position of a linearly driven drive system, of the type where the angular position change ($\Delta\alpha$) is proportional to its particular running time ($\Delta t$) and which has a processing means and associated memory, and at least two limit switches adapted to operate at respective known predetermined angular positions, the process comprising the steps of:

determining a value of the angular velocity (W) of the drive system with the aid of two of said limit switches and storing said determined desired value ($\Delta t_S$) of the running time ($\Delta t$) of the drive system corresponding to the desired angular position ($\alpha_S$) in said memory for later use by said processing means.

determining a desired value ($\Delta t_S$) for the running time ($\Delta t$) of the drive system corresponding to the desired angular position value ($\alpha_S$);

starting the drive system and measuring its running time ($\Delta t$); and stopping the drive system when a measured value of the running time ($\Delta t$) is equal to a determined desired value ($\Delta t_S$) of the running time ($\Delta t$)

recalibrating said drive system by cyclically starting the drive system from the angular position defined by at least one of several limit switches (3) and determining a desired-value/actual-value difference (D) for a predetermined desired value ($\Delta t_{S,E}$) and for a measured actual value ($\Delta t_E$) of a running time ($\Delta t$) which is required when proceeding from a known momentary angular position ($\alpha_A$) of the drive system, to reach one of said limit switches (3), and multiplying the angular velocity (W) of the drive system by a correction factor (k) which is a function of the desired-value/actual-value difference (D) to obtain an angular velocity ($W_E$) which is subsequently used in the process until a subsequent recalibrating step is carried out for determining of the desired value ($\Delta t_S$) of the running time ($\Delta t$).

* * * * *

UNITED STATES PATENT AND TRADEMARK OFFICE

CERTIFICATE OF CORRECTION

PATENT NO. : 5,710,725
DATED : January 20, 1998
INVENTOR(S) : Bott et al.

It is certified that error appears in the above-identified patent and that said Letters Patent is hereby corrected as shown below:

Column 2, line 62, delete "$\Delta 1$" and insert

--$\propto 1$-- therefor

Column 3, line 8, delete "has;" and insert

--has,-- therefor

Column 3, line 9, delete "$t_l$" and insert --t1-- therefor

Column 3, line 20, after "operation" delete

"," and insert --.-- therefor

Column 4, line 6, delete "starling" and insert

--starting-- therefor

UNITED STATES PATENT AND TRADEMARK OFFICE

CERTIFICATE OF CORRECTION

PATENT NO. : 5,710,725
DATED : January 20, 1998
INVENTOR(S) : Bott et al.

It is certified that error appears in the above-identified patent and that said Letters Patent is hereby corrected as shown below:

Column 4, line 55, delete "fore" and insert

--from -- therefor

Signed and Sealed this

Eighth Day of September, 1998

*Attest:*

*Attesting Officer*

Bruce Lehman

BRUCE LEHMAN

*Commissioner of Patents and Trademarks*